United States Patent [19]

Pellmann

[11] Patent Number: 4,800,631

[45] Date of Patent: Jan. 31, 1989

[54] MODULAR CASKET

[76] Inventor: Russell R. Pellmann, 1702 Cass Ave., Libertyville, Ill. 60048

[21] Appl. No.: 69,161

[22] Filed: Jul. 2, 1987

[51] Int. Cl.[4] ..... A61G 17/00

[52] U.S. Cl. ..... 27/7; 27/2

[58] Field of Search ..... 27/2, 3, 4, 5, 6, 7; 52/128, 136, 137, 140, 141, 142; 220/4 C, 4 F, 6, 62

[56] References Cited

U.S. PATENT DOCUMENTS

| | | | |
|---|---|---|---|
| 275,665 | 4/1883 | Johnson | 27/2 |
| 638,075 | 11/1899 | St. Jean | 27/27 |
| 768,481 | 8/1904 | Post | 27/2 |
| 801,264 | 10/1905 | Post | 27/6 |
| 1,093,648 | 4/1914 | Potter | 220/469 |
| 1,950,823 | 3/1934 | Starrick | 27/19 |
| 2,508,319 | 5/1950 | Westenhaver | 27/35 |
| 2,617,171 | 11/1952 | Kimmel | 27/7 |
| 2,806,278 | 9/1957 | Crump | 27/35 |
| 2,974,390 | 3/1961 | Nelson | 27/7 |
| 3,050,817 | 8/1962 | Pare | 27/7 |
| 3,283,386 | 11/1966 | Cenegy | 27/3 |
| 3,446,415 | 5/1969 | Bromley | 220/62 X |
| 3,490,114 | 1/1970 | Connelly et al. | 27/2 |
| 3,541,747 | 11/1970 | Olson et al. | 52/141 |
| 3,545,055 | 12/1970 | Pare | 27/7 |
| 3,729,786 | 5/1973 | Walding | 27/3 |
| 3,802,591 | 4/1974 | Mizushima et al. | 220/465 |
| 3,879,818 | 4/1975 | Rowland | 27/7 |
| 4,209,880 | 7/1980 | Lidholm | 27/2 |
| 4,320,562 | 3/1982 | Kelley | 27/2 |

*Primary Examiner*—Robert A. Hafer
*Assistant Examiner*—Samuel Rimell
*Attorney, Agent, or Firm*—Welsh & Katz, Ltd.

[57] ABSTRACT

A modular casket includes a body receiving compartment defined by at least one modular base section having a rectangular base panel and a pair of rectangular side panels integrally hingedly connected to the base panel along longitudinal marginal edges, and a pair of modular end pieces each of which includes a bottom wall and an upstanding end wall. The base panel, side panels and modular end pieces have mutually cooperable connecting flanges formed thereon which are adapted for selective interconnection to establish a body receiving compartment having an upper peripheral edge on which a modular cover lid may be mounted in sealed relation. The various modular components are made of a lightweight, high strength double-wall plastic construction and facilitate shipment and storage in compact kit form for assembly at the point of use without special tools.

23 Claims, 3 Drawing Sheets

MODULAR CASKET

BACKGROUND OF THE INVENTION

The present invention relates generally to burial caskets, and more particularly to a novel modular lightweight casket which is economical and facilitates shipping in an unassembled kit condition and assembly at the point of use without special tooling.

Through the ages, caskets or burial coffins have taken different forms ranging from ornate caskets made of heavy metal or a combination of wood and metal and generally reserved for the upper class, to caskets of relatively modest design fabricated from pineboards and the like and which afford persons of a substantially lesser economic and social status a respectful burial. More recent trends in casket and burial vault designs have resulted in the development of caskets made from plastic materials which are resistant to moisture and the chemical action of substances in the earth. See, for example, U.S. Pat. Nos. 2,508,319; 2,617,171; 2,806,278; 2,974,390; 3,283,386; 3,879,818; and 4,320,562. Caskets have also been made of asbestos cement composition to resist moisture and chemical action. See U.S. Pat. No. 3,050,817.

SUMMARY OF THE INVENTION

One of the primary objects of the present invention is to provide a novel modular casket employing lightweight modular components formed from plastic material and which enable sealed assembly without special tools.

A more particular object of the present invention is to provide a novel modular casket wherein the various modular components are made of a lightweight, high strength double-wall plastic construction facilitating assembly at the point of use to provide a fully sealed interconnection between the various components.

A feature of the modular casket in accordance with the invention lies in the provision of a body receiving compartment defined by at least one base section having a base panel and integaal hingedly connected side panels, the base and side panels having mutually cooperable connecting flanges enabling sealed connection of the base section to similar base sections or to modular end pieces having similar mutually cooperable connecting flanges so as to maintain the modular components in assembled relation.

Another feature of the modular casket in accordance with the invention lies in its ability to be packed in a compact disassembled kit condition for shipment and/or storage, thereby facilitating economical shipment and assembly at its point of use.

A feature of one embodiment of the modular casket in accordance with the invention lies in the provision of novel reusable carrying means in the form of a carrier framework adapted for interfitting releasable relation with the casket but which is removable for subsequent use with other caskets.

Further objects, features and advantages of the invention, together with the organization and manner of operation thereof, will become apparent from the following detailed description of the invention when taken in conjunction with the accompanying drawings wherein like reference numerals designate like elements throughout the several views.

DETAILED DESCRIPTION

Figure 1:
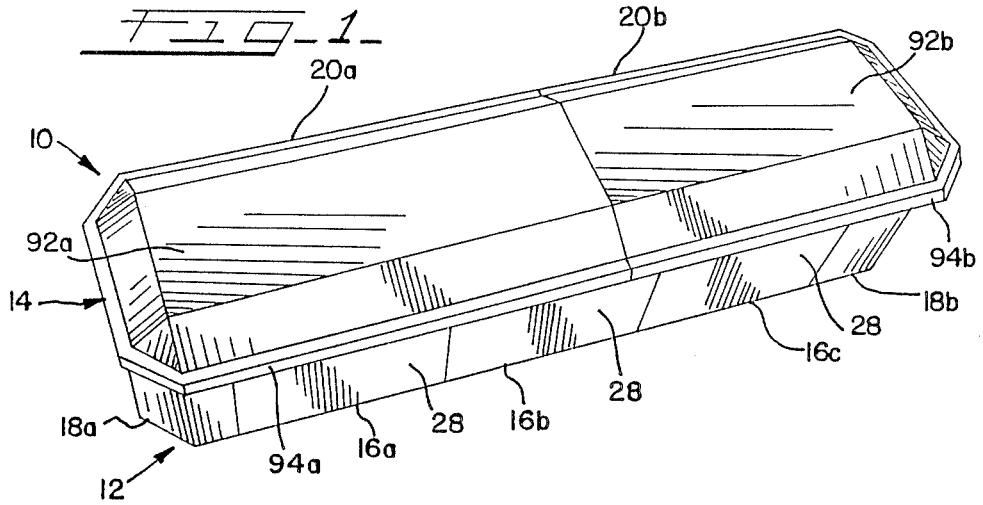
FIG. 1 is a perspective view of an assembled modular casket constructed in accordance with the present invention.

Referring now to the drawings, a modular lightweight casket constructed in accordance with the present invention is indicated generally at 10 in FIG. 1. The modular casket 10 includes a body receiving compartment, indicated generally at 12, and an upper cover lid, indicated generally at 14. The body compartment 12 includes a plurality of modular base sections, indicated at 16*a*, 16*b* and 16*c*, which are selectively attachable to each other and to a pair of similar modular end pieces 18*a* and 18*b* to define the body receiving compartment. In the illustrated embodiment, the cover lid or top 14 is comprised of two modular sections 20*a* and 20*b* which are adapted for interconnection to form a unitary cover lid adapted to seal with the upper peripheral edge of the body compartment when assembled thereon.

Figure 2:
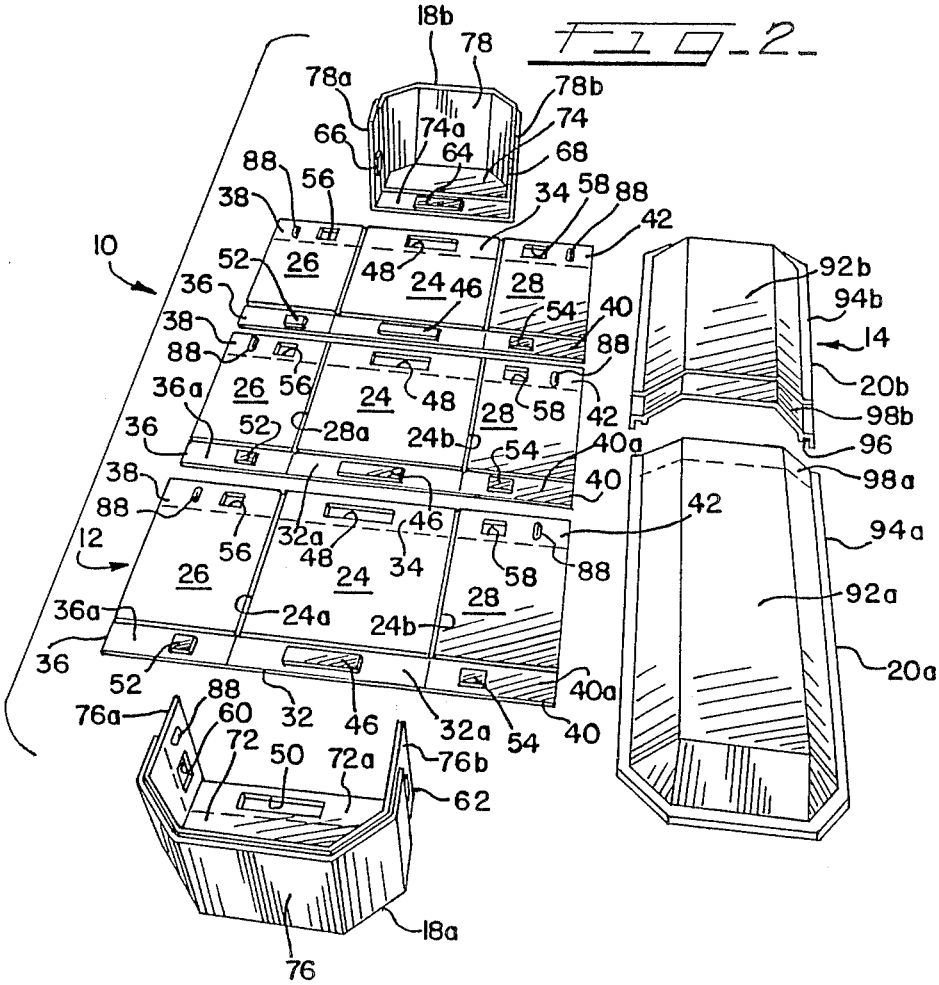
FIG. 2 is a perspective view of the casket of FIG. 1 but with the various modular components disassembled.
Figure 3:
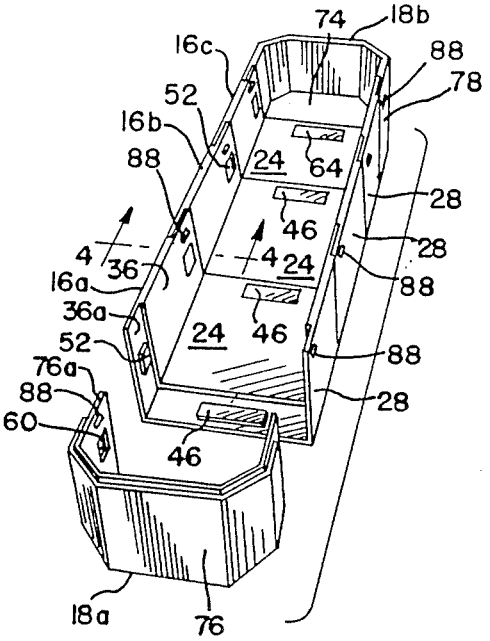
FIG. 3 is a perspective view illustrating the modular components comprising the body receiving compartment in partially assembled relation.

Referring to FIGS. 2 and 3, each of base sections 16*a*, 16*b* and 16*c* includes a planar rectangular base panel 24 and a pair of planar substantially rectangular side panels 26 and 28 of equal size. The side panels 26 and 28 are integrally hingedly connected to their associated base panel 24 along longitudinal marginal edges 24*a* and 24*b*, respectively, so as to form hinge axes enabling movement of the side panels between positions generally coplanar with the base panels, as illustrated in FIG. 2, and upstanding positions generally normal to the base panels as illustrated in FIG. 3.

In accordance with one feature of the modular casket 10, the various modular base sections 16*a–c* and end pieces 18*a, b* comprising the body receiving compartment 12 have connecting flanges formed integral thereon which are adapted for selective interfitting relation so as to provide structural strength and integrity for the assembled modular components of the body receiving compartment. Referring to FIGS. 2–5, each base panel 24 has a pair of transverse generally equal size connecting flanges 32 and 34 formed at its opposite ends. In the illustrated embodiment, the connecting flange 32 is coplanar with the lower surface of the associated base panel 24 and defines a transverse recess 32*a* along the upper surface of the base panel. The connecting flange 34 is coplanar with the upper surface of the base panel and defines a transverse recess 34*a* facing the lower surface of the associated base panel.

Similarly, each of the side panels 26 and 28 has a pair of similar connecting flanges, indicated at 36 and 38 on panel 26 and at 40 and 42 on panel 28, formed at its opposite ends in transverse alignment with the corresponding connecting flanges 32 and 34 on the base panel 24. The connecting flanges on the corresponding ends of the base and side panels are integrally connected through hinge axes which form extensions of the hinge axes 24*a* and 24*b*. The opposite connecting flanges 32 and 34 on the base panels 24 and the opposite connecting flanges 36, 38 and 40, 42 on the side panels 26 and 28, respectively, are adapted for releasable interlocking relation such that the transversely aligned connecting flanges 32, 36 and 40 on one modular base section, such as 16*a*, may be interlocked with the transversely aligned connecting flanges 34, 38 and 42, respectively, on another similar modular base section, such as 16*b* or 16*c*. Similarly, the connecting flanges on the base sections 16*a–c* are adapted for selective interlocking with connecting flanges formed on the end pieces 18*a,b*.

To facilitate such interlocking, the connecting flange 32 on each base panel 24 has a generally rectangular raised projection or interlock element 46 extending upwardly from its recessed surface 32*a*. Each interlock element 46 is adapted to be snugly received within a similarly configured rectangular opening 48 formed in a connecting flange 34 of another one of the base sections 16*a–c* or in a rectangular opening 50 formed in the end piece 18*a*. Each of the side panel connecting flanges 36 and 40 has a generally rectangular raised interlock element, indicated at 52 and 54, respectively, formed thereon so as to project from the correspondin recess surface 36*a* or 40*a*. The interlock elements 52 and 54 are adapted to be snugly received, respectively, within similarly configured openings 56 and 58 formed in the connecting flanges 38 and 42 of other base section so as to provide interlocking between the connecting flanges. The interlock elements 52 and 54 are also adapted for interlocking relation with the end piece 18*a* through rectangular openings 60 and 62 formed in connecting flanges on the end piece as will be described. The end piece 18*b* has rectangular projecting interlock elements 64, 66 and 68 formed thereon which are adapted to be snugly received, respectively, within the rectangular openings 48, 56 and 58 in a selected base section of the body compartment 12 during assembly The end pieces 18*a* and 18*b* are generally similar in configuration in that each has a substantially planar base wall, indicated at 72 and 74, respectively, formed integral with upstanding end walls 76 and 78, respectively. Each of the end walls 76, 78 is defined by a plurality of integrally connected wall panels of a height equal to the height of the side panels 26 and 28 when in upstanding relation to their associated base panels 24. The end piece 18*a* has connecting flanges 72*a*, 76*a* and 76*b* formed integral, respectively, with the base wall 72 and the upstanding end wall 76 and in which are formed the aforementioned rectangular openings 50, 60 and 62 for interlocking cooperation with the interlocks 46, 52 and 54 formed on a selected base section 16*a–c*.

In similar fashion, the end piece 18*b* has a connecting flange 74*a* formed integral with the base wall 74 and has upstanding connecting flanges 78*a* and 78*b* formed integral with the upstanding end wall 78. The connecting flanges 74*a*, 78*a* and 78*b* have the aforementioned raised interlock elements 64, 66 and 68 formed thereon, respectively, for interlocking relation with rectangular openings 48, 56 and 58 in a selected base section 16*a–c*.

The various modular components of the casket 10 are formed of a lightweight double wall construction which provides high strength and an appearance of structural integrity commonly associated with caskets. The modular components are preferably made of a suitable gas and liquid impervious plastic material, such as polyethylene, which lends itself to blow-molding and other suitable methods of manufacture. The use of high-strength plastic material also enables the modular components to be formed in selected colors and with textured external surfaces, if desired. The double wall construction also provides dead air spaces between the spaced walls which serve as moisture barriers Referring to FIGS. 4 and 5, the base panels 24, side panels 26 and 28, and end pieces 18*a* and 18*b* are preferably formed with a cross-sectional dimension, except for their respective connecting flanges, of approximately 1 inch. With the inner and outer walls each having a thickness of approximately 0.120 inch, a substantial dead air space is formed between the double walls. The transverse width or cross-sectional dimension of the connecting flanges on the base sections 16*a–c* and end pieces 18*a* and 18*b* is approximately one-half that of the remaining base and side panel walls such that when the connecting flanges are brought into mutually facing juxtaposed relation and selectively interlocked through the mutually cooperating rectangular interlock elements 46, 52, 54, 64, 66 and 68 and receiving openings 48, 50, 56, 58, 60 and 62, the inwardly and outwardly exposed surfaces of the connecting flanges are substantially coplanar with the inner and outer surfaces of the adjacent upstanding side panels.

The raised interlock elements 46, 52, 54, 64, 66 and 68 and corresponding rectangular openings 48, 50, 56, 58, 60 and 62 are sized to provide a snug fit such that an interference fit is generated preventing longitudinal separation of the mated connecting flanges. The remaining mutually facing surfaces of the connecting flanges are substantially planar to provide full surface sealing contact. To insure a moisture resistant seal between the interlocked connecting flanges, a flat soft gasket material (not shown) is preferably interposed between the mutually facing surfaces of the connecting flanges. The gasket may be affixed to the recessed surfaces 32*a*, 36*a* and 40*a* of the connecting flanges 32, 36 and 40, or may be applied to the outwardly facing recessed surfaces of the connecting flanges 34, 38 and 42.

Figure 5:
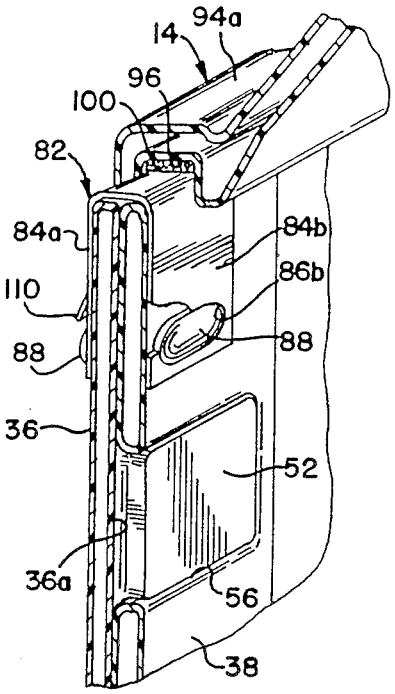
FIG. 5 is a fragmentary perspective view further illustrating the manner in which the side panels of FIG. 4 are interconnected, and showing a cover lid mounted thereon.
Figure 4:
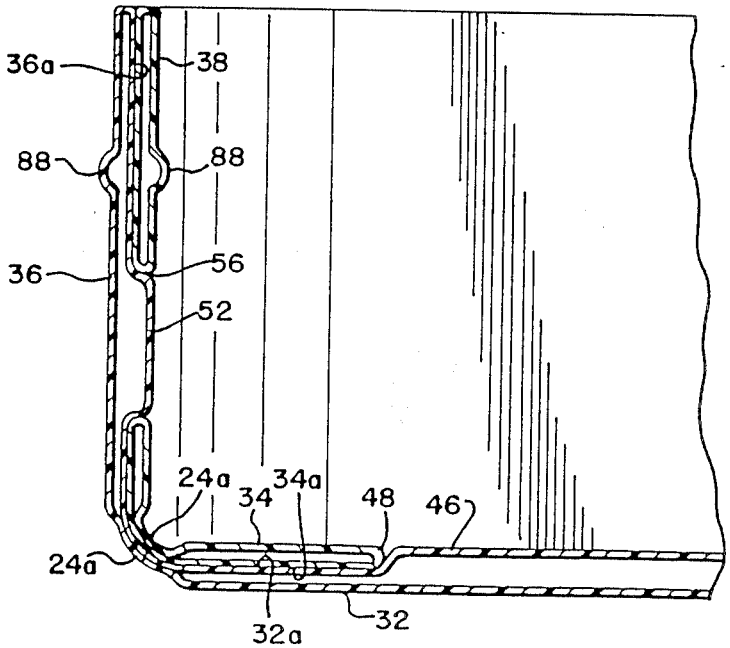
FIG. 4 is a fragmentary transverse sectional view taken substantially along line 4—4 of FIG. 3.
Figure 6:
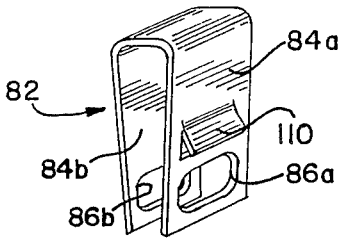
FIG. 6 is a perspective view of the snap-on clamp employed in retaining the side panels of FIG. 3.

After interlocking the connecting flanges through the interlock elements 46, 52, 54, 64, 66 and 68, the mated connecting flanges are further secured together by snap-on key-lock type clamps as indicated generally at 82 in FIG. 6. The snap-on clamps 82 are preferably made of a suitable metallic spring material and are of generally inverted U-shape so as to define opposed inwardly inclined resilient legs 84*a* and 84*b* which enable placement over a pair of juxtaposed connecting flanges, as indicated at 36 and 38 in FIG. 5. The clamp legs 84*a,b* have generally oval shaped openings therethrough, as indicated at 86*a* and 86*b* respectively, which are positioned to receive outwardly projecting detents 88 formed on the outwardly facing surfaces of the connecting flanges 36 and 40 and on the inwardly facing surfaces of the connecting flanges 38 and 42 so as to effect a locking relation between the snap-on clamps 82 and the associated connecting flanges. Similar outwardly projecting detents 88 are formed on the connecting flanges of the end members 18*a* and 18*b* to facilitate locking cooperation with clamps 82 when assembled with a base section.

Figure 7:
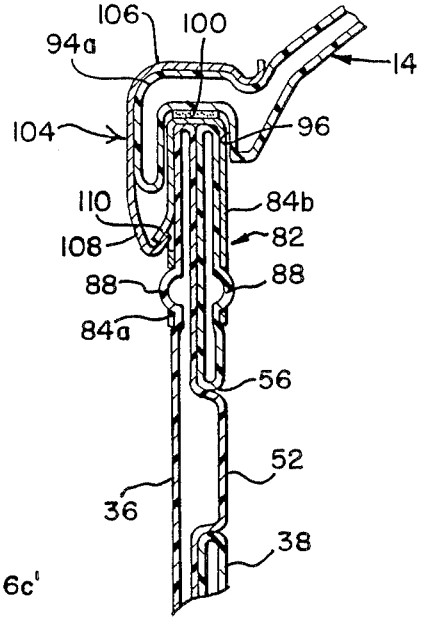
FIG. 7 is a fragmentary transverse section view generally similar to FIG. 5 but further showing a retaining clip securing the upper cover lid onto the upper edge of the body receiving compartment.

As noted, the sections 20*a* and 20*b* of the cover lid 14 are formed of a lightweight, high strength plastic double wall construction. In the illustrated embodiment, the cover lid sections 20*a* and 20*b* have upper planar walls 92*a* and 92*b*, respectively, which are interconnected through inclined walls to corresponding peripheral mounting flanges 94*a* and 94*b*, respectively. The mounting flanges 94*a,b* are of inverted generally U-shape in transverse cross section so as to define mounting grooves or recesses 96 as shown in FIGS. 5 and 7. The cover lid sections 20*a,b* may be of equal longitudinal length or of different lengths and have mutually cooperable connecting flanges, indicated at 98*a* and 98*b*, respectively, formed thereon which are adapted for surface-to-surface sealing relation when the cover lid sections are assembled onto the body receiving compartment 12 of the casket. Preferably, a strip of broad faced gasket material is affixed to the downwardly facing surface of the connecting flange 98*a* or the upwardly facing surface of the connecting flange 98*b* to provide improved sealing between the cover lid sections. An elongated flat moisture impermeable gasket is also preferably affixed within the peripheral mounting groove or recess 96 in each cover lid section, as indicated at 100 in FIGS. 5 and 7.

Figure 10:
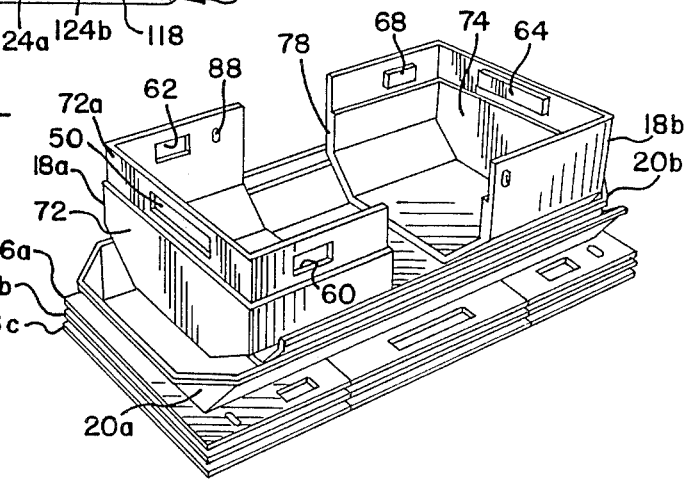
FIG. 10 is a perspective view illustrating the various modular components of the casket of FIG. 1 in a disassembled compact kit form for shipping and storage.

A feature of the modular casket in accordance with the invention lies in the fact that the various modular components may when disassembled be packed into a compact shipping package or kit as illustrated in FIG. 10. In this condition, the base sections 16*a–c* are stacked flat, the cover lid sections 20*a,b* are placed on the stacked base sections in inverted nested relation, and the end pieces 18*a,b* are placed on the cover lid sections in inverted positions. The required clamps 82, retainer clips 104, liner materials and any other materials, such as assembly instructions and the like, may be inserted into the upwardly facing end pieces for shipment. With the various modular components being so positioned, one or more securing straps may be placed about the stacked components to maintain them in the illustrated shipping condition. A protective shipping wrap, such as tough plastic sheet, may be applied about the stacked components if desired. The modular components when in their stacked shipping condition have a packaged volume which is approximately 65% less than the volume of the casket when fully assembled, thus greatly reducing shipping costs.

In preparing the casket for use, a selected number of base sections, such as 16*a–c*, are assembled in end-to-end relation depending on the length of the casket needed. The end pieces 18*a* and 18*b* are then affixed to the base sections through their connecting flanges as aforedescribed. After assembling the base sections and end pieces, a suitable liner and associated padding may be inserted into the body receiving compartment 12 and secured therein by means of an inwardly facing peripheral groove (not shown) formed slightly below the upper edges of the side panels and end piece walls.

If, after assembly of the body receiving compartment 12, it is desired that the body be partially exposed during a mourning period, only one section of the cover lid, such as section 20*a*, may be assembled onto the body receiving compartment. Upon placement of one or both of the cover lid sections onto the upper peripheral edge of the body receiving compartment, the cover lid sections are releasably affixed thereon through a plurality of retainer clips 104. Each retainer clip 104 is adapted for cooperation with a selected one of the snap-on clamps 82 so as to secure the corresponding cover lid section onto the body receiving compartment. To this end, each retaining clip 104 is of generally C-shape and has an upper curved end 106 having a profile curvature corresponding to the upwardly facing curvature of the mounting flanges 94*a,b* on the cover lid sections. A generally J-shaped hook portion 108 is adapted for locking cooperation with a downwardly and outwardly inclined retainer arm 110 formed on each of the clamps 82. Thus, by hooking the hook portion 108 of a clip 104 beneath a retainer arm 110 on an assembled clamp 82, the resilient upper end 106 of the clip may be forced over the upper surface of the corresponding cover lid mounting flange 94*a* or 94*b*to its fully assembled position. In this manner, the cover lid sections are releasably secured onto the body receiving compartment with the seal 100 engaging the upper edge of the body receiving compartment.

Figure 9:
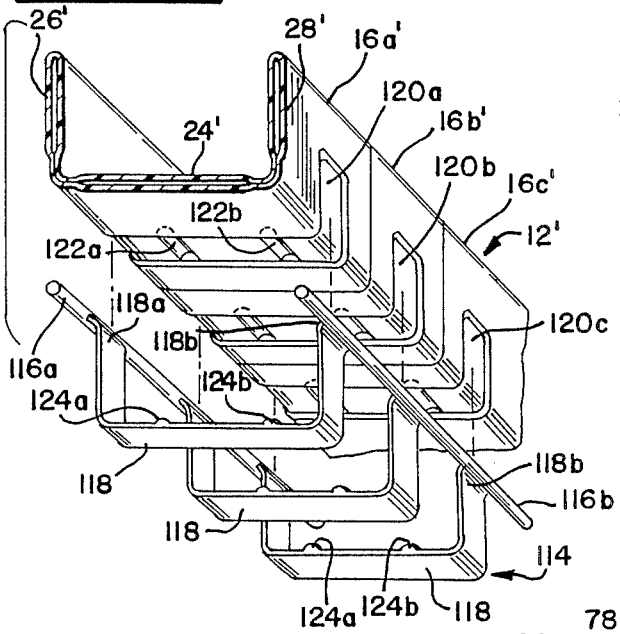
FIG. 9 is a fragmentary perspective view illustrating an alternative embodiment of a modular body receiving compartment adapted for cooperation with a reusable carrier.
Figure 8:
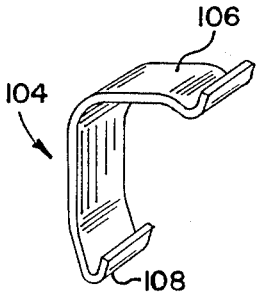
FIG. 8 is a perspective view illustrating a typical cover retaining clip.

FIG. 9 illustrates a fragmentary portion of an alternative body receiving compartment 12' having modular base section 16'*a*, 16'*b* and 16'*c* which facilitate releasable cooperation with a reusable modular carrier 114. The carrier 114 has a pair of elongated carrier arms 116*a* and 116*b* to which are affixed a plurality of generally U-shaped carrier members 118 corresponding in number to the base sections 16'*a–c*. The carrier members 118 are preferably made of a suitable strength rigid material and have outwardly curved upper ends 118*a* and 118*b* affixed to the carrier arms 116*a* and 116*b*. Each of the base sections 116'*a–c* has a recess formed in its external surface, such as indicated at 120*a*, 120*b* and 120*c*, respectively, which is sized to receive a corresponding one of the carrier members 118 in nested relation therewith. A pair of generally semi-cylindrical recesses or indentations, indicated at 122*a* and 122*b*, are preferably formed in the base panel of each of the base sections 16'*a–c* to receive similarly configured projections 124*a* and 124*b*formed on the carrier members 118. In this manner, each carrier member 114 nests with an associated base section of the body receiving compartment to facilitate carrying of the casket, and may be detached therefrom when the casket is lowered within the ground or inserted into a burial vault. It will be understood that other types of carrier means may be employed to facilitate carrying of the casket. For example, carrier handles may be formed integral with or otherwise suitably secured to the outer surfaces of the side panels 26 and 28 of the base sections 16*a–c* if desired.

Thus, in accordance with the invention, a very economical modular casket is provided in which the various modular components may be stored and shipped in a compact disassembled kit condition and assembled at the point of use without need for special tools. The modular casket of the invention provides significant advantages over prior caskets through the use of a high strength yet lightweight double wall plastic construction which is resistant to the adverse effects of ground moisture and other chemical substances within the earth. The modular components lend themselves the assembly of different size caskets, at the point of use, thus further enhancing the economic advantages of the invention.

While preferred embodiments of the invention have been illustrated and described, it will be understood that changes and modifications may be made therein without departing from the invention in its broader aspects. Various features of the invention are defined in the following claims.

What is claimed is:

1. A modular casket comprising, in combination, a body receiving compartment including at least one modular base section having a substantially rectangular base panel and a pair of substantially rectangular side panels integrally hingedly connected to said base panel along opposite longitudinal marginal edges thereof so as to enable movement of said side panels between positions generally coplanar with said base panel and upstanding positions generally normal to said base panel, a pair of modular end pieces each of which includes a bottom wall and an upstanding end wall affixed at a lower edge to said bottom wall in sealed relation therewith, said base panel, side panels and modular end pieces having mutually cooperable connecting flanges adapted for selective releasable interlocking engagement to establish a generally rectangular body receiving compartment having an upper peripheral edge, and a modular cover lid adapted to be mounted on said body receiving compartment in sealed relation thereon so as to close said body receiving compartment.

2. A modular casket as defined in claim 1 wherein said base section, end pieces and modular lid are formed of a double-walled non-metallic material.

3. A modular casket as defined in claim 2 wherein said non-metallic material comprises a plastic material.

4. A modular casket as defined in claim 1 wherein said connecting flanges define mutually cooperable interlock means enabling said selective releasable interlocking engaement therebetween.

5. A modular casket as defined in claim 1 wherein said base panel and said side panels are generally planar.

6. A modular casket as defined in claim 1 wherein said upstanding end walls of said modular end pieces are defined by a plurality of integrally interconnected wall panels.

7. A modular casket as defined in claim 1 wherein said modular base section, modular end pieces and modular cover lid are formed of a lightweight double wall construction defining dead air space between the double walls through a substantial portion of each modular component.

8. A modular casket as defined claim 7 wherein said modular components are made from a gas and liquid impervious plastic material.

9. A modular casket as defined claim 1 wherein selected ones of said connecting flanges define raised interlock elements thereon, and others of said connecting flanges have interlock openings therein adapted to snugly receive said interlock elements when said connecting flanges are selectively positioned in juxtaposed relation whereby to maintain said connecting flanges in selective releastable interlocking relation.

10. A modular casket as defined in claim 9 including gasket means interposed between mutually opposed surfaces of said connecting flanges when in said juxtaposed interconnected relation.

11. A modular casket as defined claim 1 wherein said cover lid is defined by at least two lid sections having mutually cooperable connecting flanges.

12. A modular casket as define in claim 1 wherein said cover lid has a mounting groove formed about its full periphery, said mounting groove being adapted to receive said peripheral edge of said body receiving compartment when mounted thereon.

13. A modular casket as defined in claim 12 including a sealing gasket disposed within said mounting groove so as to effect sealing engagement with said upper peripheral edge of said body receiving compartment.

14. A modular casket as defined in claim 1 including a plurality of clamp members each of which is adapted to clamp a pair of mutually cooperative connecting flanges in juxtaposed connected relation.

15. A modular casket as defined in claim 14 including a plurality of snap-on fastener clips mutually cooperable with said clamp members and said cover lid so as to releasably retain said cover lid on said body receiving compartment.

16. A modular casket as defined in claim 1 including a plurality of said modular base sections adapted to be interconnected in end-to-end relation to provide a desired length body receiving compartment.

17. A modular casket as defined in claim 1 wherein said base section, end pieces and modular lid are adapted for stacking in substantially nested relation for storage and/or shipping when in disassembled relation.

18. A modular casket as defined in claim 1, and further including a modular reusable carrier releasably cooperable with said body receiving compartment so as to facilitate carrying of the casket.

19. A modular casket as defined in claim 18 wherein said body receiving compartment has a plurality of longitudinally spaced recesses formed in its outer surface, and wherein said carrier includes a pair of elongated handles interconnected through substantially U-shaped carrier members adpated to receive said body receiving compartment in nested relation therein with said carrier members being received within said external recesses in said body receiving compartment.

20. A kit for making a modular casket comprising at least one base section having a substantially rectangular base panel and a pair of substantially rectangular side panels integrally hingedly connected to said base panel along opposite longitudinal marginal edges thereof so as to enable movement of said side panels between positions generally coplanar with said base panel and upstanding positions generally normal to said base panel, a pair of modular end pieces each of which includes a bottom wall and an upstanding end wall, said base panel, side panels and modular end pieces having mutually cooperable connecting flanges adapted for selective interlocking engagement to define a body receiving compartment having an upper peripheral edge, and a modular cover lid adapted to be mounted on said upper edge of said body receiving compartment in a manner to effect a continuous seal therewith and close said body receiving compartment.

21. A modular casket kit as defined in claim 20 wherein said base section, end pieces and modular lid are formed of a double-walled non-metallic material.

22. A modular casket kit as defined in claim 21 wherein said non-metallic material comprises a suitable plastic material.

23. A modular casket kit as defined in claim 20 wherein said connecting flanges define mutually cooperable male and female interlock means enabling said releasable interlocking engagement therebetween.

* * * * *